US012584299B2

(12) United States Patent
Conway

(10) Patent No.: US 12,584,299 B2
(45) Date of Patent: Mar. 24, 2026

(54) PLUMBING OR ABLUTIONARY SYSTEM

(71) Applicant: KOHLER MIRA LIMITED, Cheltenham (GB)

(72) Inventor: Sean Conway, Cheltenham (GB)

(73) Assignee: Kohler Mira Limited, Cheltenham (GB)

( * ) Notice: Subject to any disclaimer, the term of this patent is extended or adjusted under 35 U.S.C. 154(b) by 154 days.

(21) Appl. No.: 18/498,457

(22) Filed: Oct. 31, 2023

(65) Prior Publication Data

US 2024/0159028 A1 May 16, 2024

(51) Int. Cl.

| | |
|---|---|
| ***E03C 1/044*** | (2006.01) |
| ***E03C 1/00*** | (2006.01) |
| ***E03C 1/04*** | (2006.01) |

(52) U.S. Cl.

CPC ..... *E03C 1/044* (2013.01); *E03C 1/0408* (2013.01); *E03C 2001/005* (2013.01)

(58) Field of Classification Search

CPC ..... E03C 1/044; E03C 1/0408

USPC ..... 165/66

See application file for complete search history.

(56) References Cited

U.S. PATENT DOCUMENTS

| | | | | |
|---|---|---|---|---|
| 4,300,247 | A * | 11/1981 | Berg | E03C 1/00 4/596 |
| 5,791,401 | A * | 8/1998 | Nobile | F28D 21/0012 165/47 |
| 8,104,532 | B2 * | 1/2012 | Cardone | F28D 21/0012 165/56 |
| 9,284,721 | B2 * | 3/2016 | Gilbert | E03C 1/044 |
| 10,072,897 | B2 * | 9/2018 | Schmid | F28D 1/0213 |
| 2017/0198982 | A1 * | 7/2017 | Törnquist | F28D 7/082 |

FOREIGN PATENT DOCUMENTS

| | | |
|---|---|---|
| GB | 2295666 A | 6/1996 |

OTHER PUBLICATIONS

GB Official Action dated Apr. 11, 2025 issued in corresponding United Kingdom application.

* cited by examiner

*Primary Examiner* — Christine J Skubinna
(74) *Attorney, Agent, or Firm* — Husch Blackwell LLP

(57) ABSTRACT

A plumbing or ablutionary system is provided, in which a water supply stream flow path from a water supply inlet to a water supply outlet, such that a water supply stream flowing in a water supply pipe is in an antiparallel counter-flow heat exchanging relationship with a waste water stream flowing along a length of a serpentine portion of a waste water conduit. When the waste water stream has a higher temperature than the water supply stream heat is exchanged from the waste water stream to the water supply stream, thereby increasing the temperature of the water supply stream.

15 Claims, 7 Drawing Sheets

PLUMBING OR ABLUTIONARY SYSTEM

CROSS REFERENCE

This application claims priority to Great Britain Patent Application No. 2216882.7, filed Nov. 11, 2022, the entirety of which is hereby incorporated by reference.

FIELD OF THE INVENTION

The present disclosure relates to a plumbing or ablutionary system, in particular a plumbing or ablutionary system comprising a heat exchange apparatus for recovering heat from a waste water stream. The disclosure also relates to a heat exchange apparatus for recovering heat from a waste water stream.

BACKGROUND OF THE INVENTION

During a shower, water having a controlled temperature, e.g. a user-desired temperature, is collected in a shower tray and flows into a waste and, ultimately, to a drain. A typical user-desired temperature for showering is approximately 40° C. Energy has been expended heating water to the user-desired temperature. A waste water stream flowing into and along the waste typically has a temperature of close to the user-desired temperature for showering.

BRIEF DESCRIPTION OF THE DRAWINGS

Examples will now be described with reference to the accompanying drawings in which.

DETAILED DESCRIPTION OF THE DRAWINGS

Figure 1:
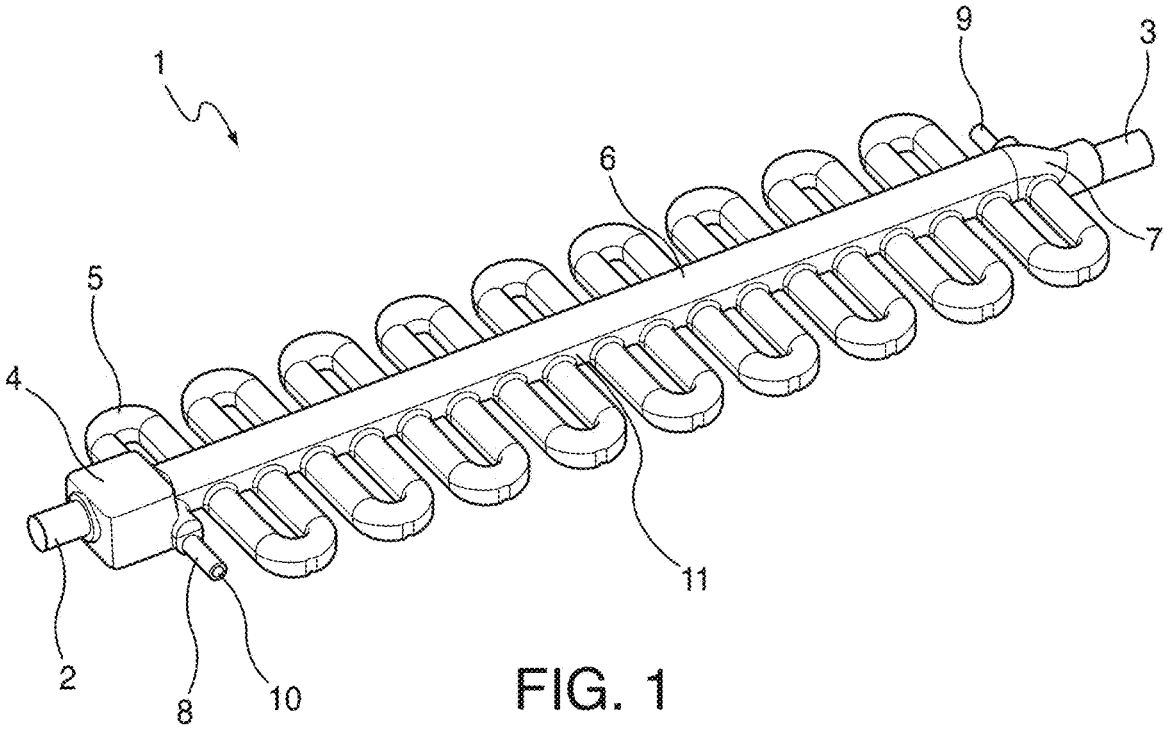
FIG. 1 is a perspective view of an example heat exchange apparatus.
Figure 2:
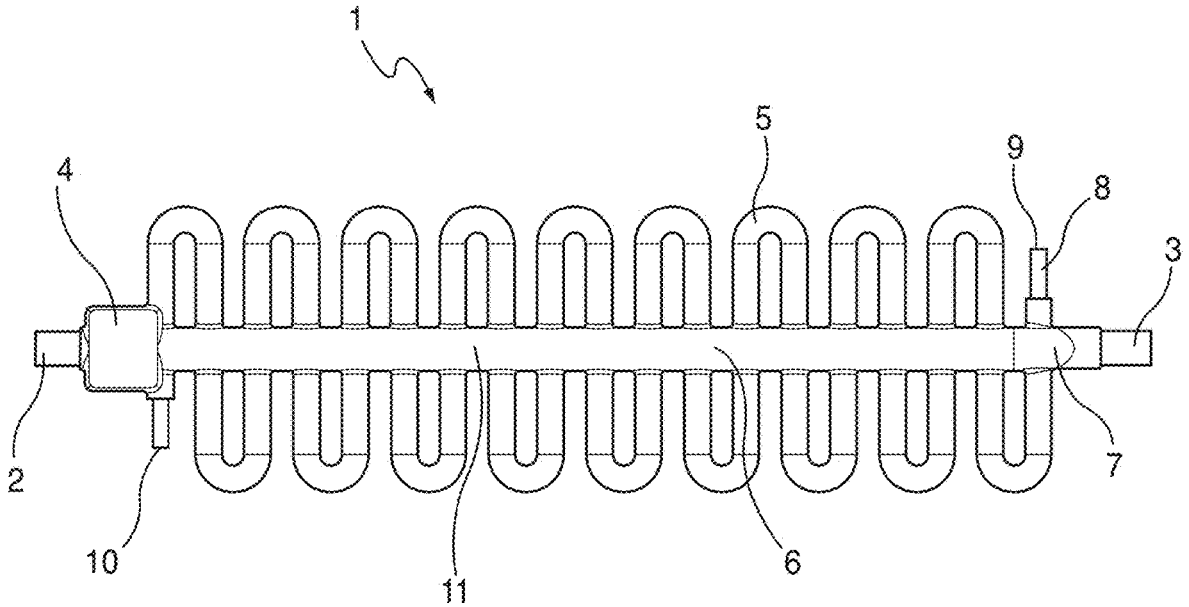
FIG. 2 is a plan view of an example heat exchange apparatus.

A first aspect provides a plumbing or ablutionary system comprising: a principal water stream device configured to receive a water supply stream and operable to provide a principal stream having a controlled temperature; a fluid delivery device arranged to receive the principal stream and emit water therefrom; a receptacle having a collection surface arranged to collect water emitted from a fluid delivery device and having a waste connected thereto; and a heat exchange apparatus comprising: a waste water inlet for receiving a waste water stream from the waste; a waste water outlet; a first waste water stream flow path from the waste water inlet to the waste water outlet, the first waste water stream flow path being provided at least in part by a waste water conduit having a serpentine portion along at least a portion of a length of the waste water conduit; a water supply inlet for receiving the water supply stream; a water supply outlet; a water supply stream flow path from the water supply inlet to the water supply outlet, the water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit; wherein when the waste water stream has a higher temperature than the water supply stream heat is exchanged from the waste water stream to the water supply stream, thereby increasing the temperature of the water supply stream prior to its being received by the means operable to provide the principal stream having a controlled temperature.

As a consequence of exchanging heat from the waste water stream to the water supply stream and thereby increasing the temperature of the water supply stream prior to its being received by the means operable to provide the principal stream having a controlled temperature, the water supply stream received by the means operable to provide the principal stream having a controlled temperature has an increased temperature. Accordingly, the means operable to provide the principal stream having a controlled temperature may not need to expend as much energy in order to provide the principal stream having a controlled temperature.

The waste water conduit may comprise a channel, a trough and/or a pipe.

The waste water conduit may be include one or more formations configured to reduce locally a width of the waste water conduit, in order to increase locally flow rate of the waste water stream along the waste water conduit. The formations configured to reduce locally a width of the waste water conduit may also serve to maintain or improve proximity of the waste water stream to the water supply pipe.

The heat exchange apparatus may comprise an overflow for excess waste water. A second waste water stream flow path from the waste water inlet to the waste water outlet may be provided at least in part by the overflow.

The heat exchange apparatus may comprise a plurality of water supply stream flow paths, each water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit.

One or more of the water supply pipes may comprise a metal tube, e.g. a copper tube. For instance, one or more of the water supply pipes may comprise a twin-walled metal tube, e.g. a twin-walled copper tube. An inner surface of one or more of the water supply pipes may comprise one or more features to promote heat transfer, e.g. heat transfer fins or the like. For example, the one or more features to promote heat transfer may comprise one or more ridges in or on the inner surface of one or more of the water supply pipes. The one or more features to promote heat transfer, e.g. one or more ridges, may extend a distance along a length of one or more of the water supply pipes. In an implementation, at least a portion of the inner surface of one or more of the water supply pipes may be rifled.

The means configured to receive a water supply stream and operable to provide a principal stream having a controlled temperature may comprise, for example, an instantaneous water heater or a mixer valve, e.g. a thermostatic mixer valve. The instantaneous water heater may comprise one or more electric heating elements operable to heat water flowing through the instantaneous water heater to a controlled temperature.

The controlled temperature may be a user-desired temperature.

The fluid delivery device may comprise, for example, a faucet or a sprayer for a shower.

The receptacle may comprise a shower tray, a bathtub, a basin or the like.

An aspect provides a heat exchange apparatus for recovering heat from a waste water stream comprising: a waste water inlet for receiving a waste water stream; a waste water outlet; a first waste water stream flow path from the waste water inlet to the waste water outlet, the first waste water stream flow path being provided at least in part by a waste water conduit having a serpentine portion along at least a portion of a length of the waste water conduit; a water supply inlet for receiving the water supply stream; a water supply outlet; a water supply stream flow path from the water supply inlet to the water supply outlet, the water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit; wherein when the waste water stream has a higher temperature than the water supply stream heat is exchanged from the waste water stream to the water supply stream, thereby increasing the temperature of the water supply stream.

The waste water conduit may comprise a channel, a trough and/or a pipe.

The waste water conduit may be include one or more formations configured to reduce locally a width of the waste water conduit, in order to increase locally flow rate of the waste water stream along the waste water conduit. The formations configured to reduce locally a width of the waste water conduit may also serve to maintain or improve proximity of the waste water stream to the water supply pipe.

The heat exchange apparatus may comprise an overflow for excess waste water. A second waste water stream flow path from the waste water inlet to the waste water outlet may be provided at least in part by the overflow.

The heat exchange apparatus may comprise a plurality of water supply stream flow paths, each water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit.

One or more of the water supply pipes may comprise a metal tube, e.g. a copper tube. For instance, one or more of the water supply pipes may comprise a twin-walled metal tube, e.g. a twin-walled copper tube. An inner surface of one or more of the water supply pipes may comprise one or more features to promote heat transfer, e.g. heat transfer fins or the like. For example, the one or more features to promote heat transfer may comprise one or more ridges in or on the inner surface of one or more of the water supply pipes. The one or more features to promote heat transfer, e.g. one or more ridges, may extend a distance along a length of one or more of the water supply pipes. In an implementation, at least a portion of the inner surface of one or more of the water supply pipes may be rifled.

An aspect provides a method of manufacture of a heat exchange apparatus for recovering heat from a waste water stream, the method comprising: providing a first part defining at least partially an outer shell of the heat exchange apparatus; providing a second part defining at least partially an outer shell of the heat exchange apparatus; accommodating a water supply pipe within the outer shell of the heat exchange apparatus, wherein a first end of the water supply pipe is disposed outboard of the outer shell of the heat exchange apparatus and a second end of the water supply pipe is disposed outboard of the outer shell of the heat exchange apparatus.

The first part and/or the second part may comprise of a polymeric material. The first part and/or the second part may be made by vacuum forming.

The method may include joining the first part to the second part.

The skilled person will appreciate that except where mutually exclusive, any feature described herein may be applied to any aspect and/or combined with any other feature described herein within the scope of the invention as set of in the claims.

With reference to FIGS. 1 to 8, there is shown a heat exchange apparatus 1 for recovering heat from a waste water stream in a plumbing or ablutionary system.

At a first end, the heat exchange apparatus 1 comprises a waste water inlet 2 for receiving, in use, a waste water stream from a waste.

The waste water inlet 2 leads to an input manifold 4 having an input manifold inlet, a first input manifold outlet and a second input manifold outlet. The input manifold inlet is configured to receive a flow of waste water from the waste water inlet 2. The first input manifold outlet leads to a first end of a waste water conduit 5. The second input manifold outlet leads to a first end of an overflow pipe 6 for excess waste water.

At a second end, the heat exchange apparatus 1 comprises a waste water outlet 3. An output manifold 7 is disposed upstream of the waste water outlet 3. The output manifold 7 includes a first output manifold inlet, a second output manifold inlet and an output manifold outlet. The first output manifold inlet is connected to a second end of the waste water conduit 5. The second output manifold inlet is connected to a second end of the overflow pipe 6. The output manifold outlet leads to the waste water outlet 3.

A water supply pipe 8 has a first end 9 and a second end 10. The water supply pipe 8 extends through the waste water conduit 5. In use, a waste water stream flowing along the waste water conduit 5 from the first end of the waste water conduit to the second end of the waste water conduit flows in the opposite direction to a water supply stream flowing along the water supply pipe 8 from the first end 9 of the water supply pipe 8 to the second end 10 of the water supply pipe 8.

The waste water conduit 5 is serpentine in form and comprises a plurality of straight sections connected by hairpin bends. In the illustrated example, the waste water conduit 5 comprises 19 straight sections and 18 hairpin bends. The straight sections of the waste water conduit 5 are oriented substantially perpendicularly to the overflow pipe 6 which extends directly in a straight line from the input manifold 4 to the output manifold 7. The waste water conduit 5 is disposed beneath the overflow pipe 6. The overflow pipe 6 is housed within and passes along an upper portion of a spine 11. The waste water conduit 5 in its serpentine form passes repeatedly through a lower portion of the spine 11 in a direction substantially perpendicular to the overflow pipe 6. The spine 11 helps to keep the heat exchange apparatus 1 relatively rigid.

The water supply pipe 8 may comprise a metal tube, e.g. a copper tube. For instance, the water supply pipe 8 may comprise a twin-walled copper tube. An inner surface of the water supply pipe 8 may comprise one or more features to promote heat transfer, e.g. heat transfer fins or the like. For example, the one or more features to promote heat transfer may comprise one or more ridges in or on the inner surface of the water supply pipe 8. The one or more features to promote heat transfer, e.g. one or more ridges, may extend a distance along a length of the water supply pipe 8. In an implementation, at least a portion of the inner surface of the water supply pipe 8 may be rifled. The one or more features to promote heat transfer, e.g. one or more ridges, in or on the inner surface of the water supply pipe 8 may serve to reduce, disrupt or prevent local recirculations or "dead zones", which may provide for a more efficient utilisation of the water supply pipe 8.

Figure 8:
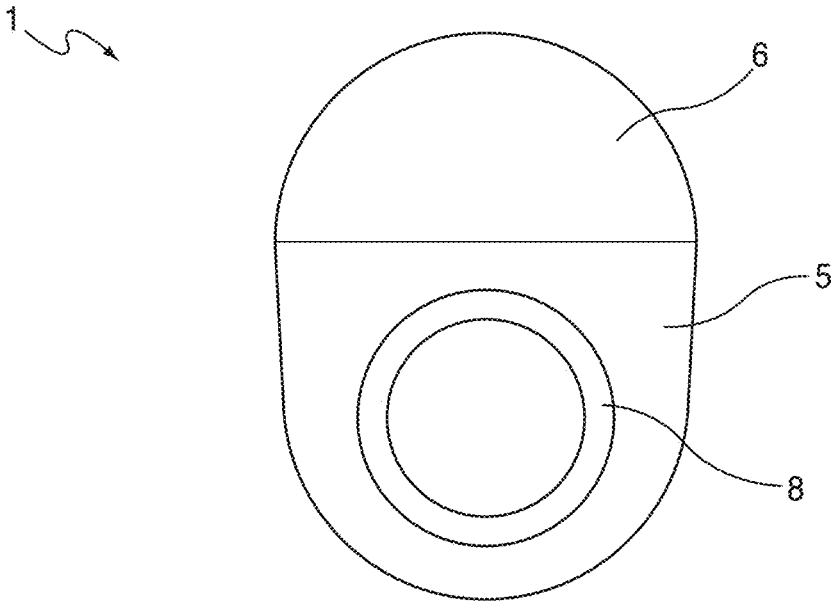
FIG. 8 is a cross-sectional view through a portion of an example heat exchange apparatus.

As can be seen clearly in FIG. 8, the water supply pipe 8 is spaced from the inner surfaces of the waste water conduit 5. Accordingly, in use, the water supply pipe 8 may be surrounded by the waste water stream flowing along the waste water conduit 5.

In use, the water supply stream flowing in the water supply pipe 8 is in an antiparallel counterflow heat exchanging relationship with the waste water stream flowing along a length of the serpentine portion of the waste water conduit 5.

Figure 4:
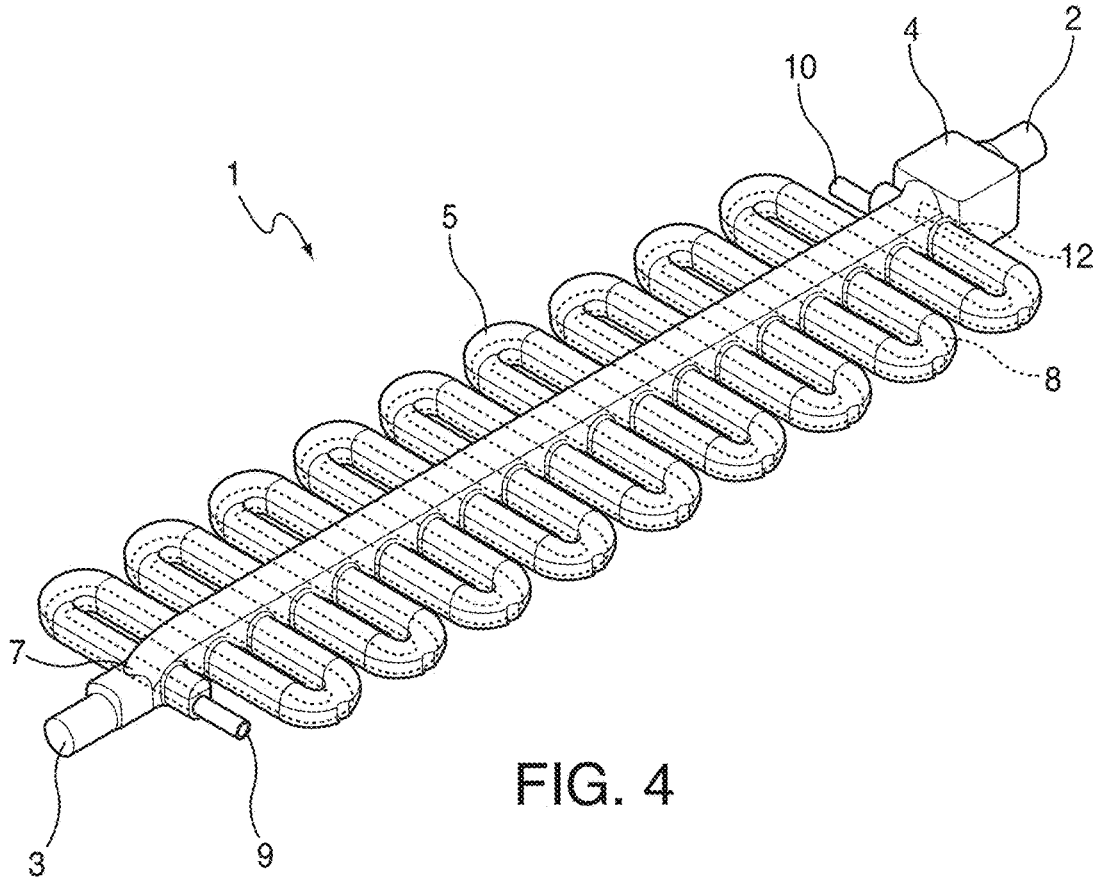
FIG. 4 is a partially transparent perspective view of an example heat exchange apparatus.
Figure 5:
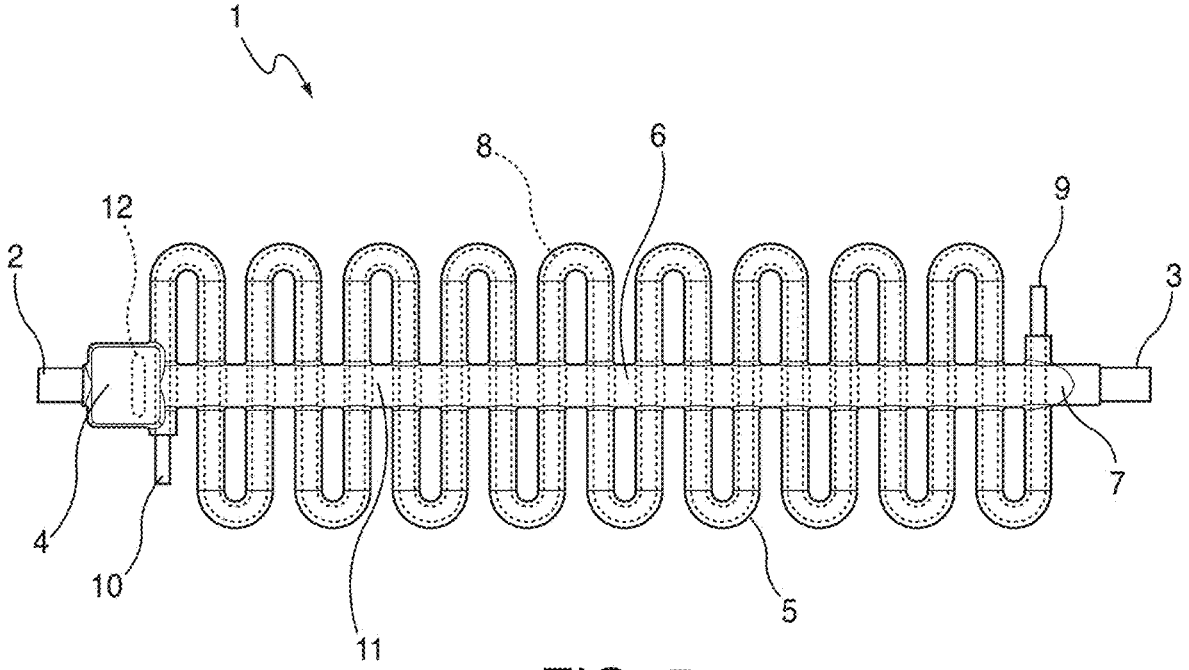
FIG. 5 is a partially transparent perspective view of an example exchange apparatus.
Figure 6:
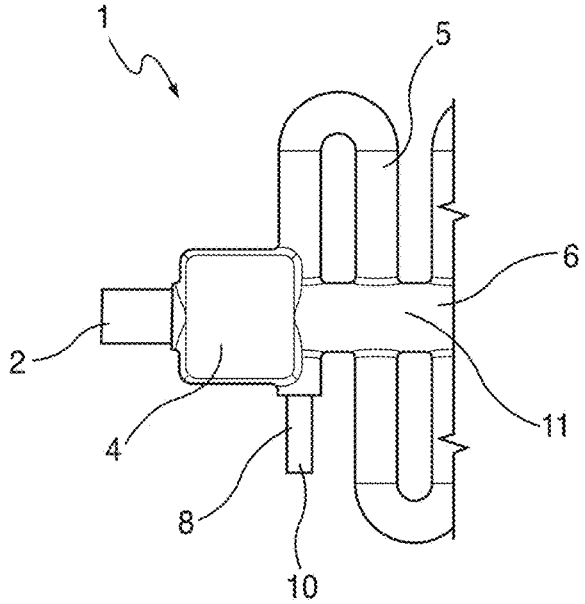
FIG. 6 is an enlarged plan view of a portion of an example heat exchange apparatus.
Figure 7:
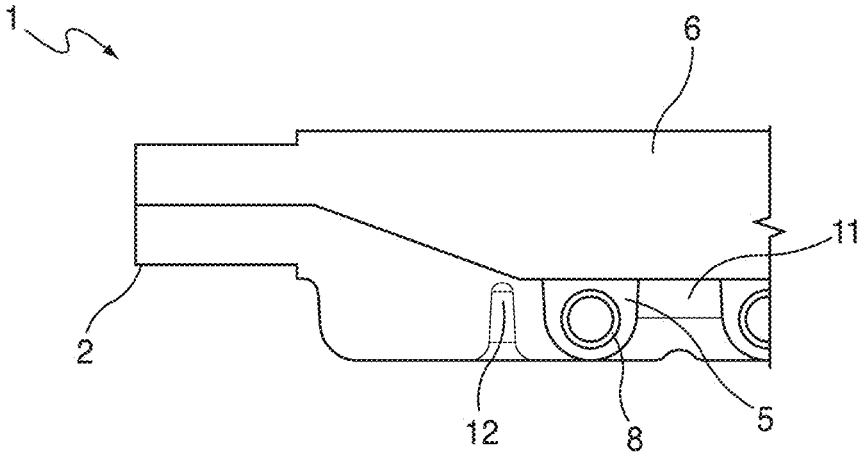
FIG. 7 is a cross-sectional view through a portion of an example heat exchange apparatus.

As shown in FIGS. 4, 5 and 7, there is a weir 12 within the input manifold 4. The weir 12 does not extend fully across a width of a waterway through the input manifold. In use, the waste water flow stream flows around the ends of the weir 12 and into the waste water conduit 5. If the flow of the waste water stream is so great that water flows over the top of the weir 12, then at least a portion of the portion of the waste water stream flowing over the top of the weir 12 enters the overflow pipe 6. The overflow pipe 6 thus serves to reduce or prevent any build-up of water, in use, within an upstream receptacle or water collection device such as a shower tray or a bathtub by permitting, when necessary, a higher flow rate of the waste water stream to pass through the heat exchange apparatus and onwards to a drain downstream thereof.

Figure 3:
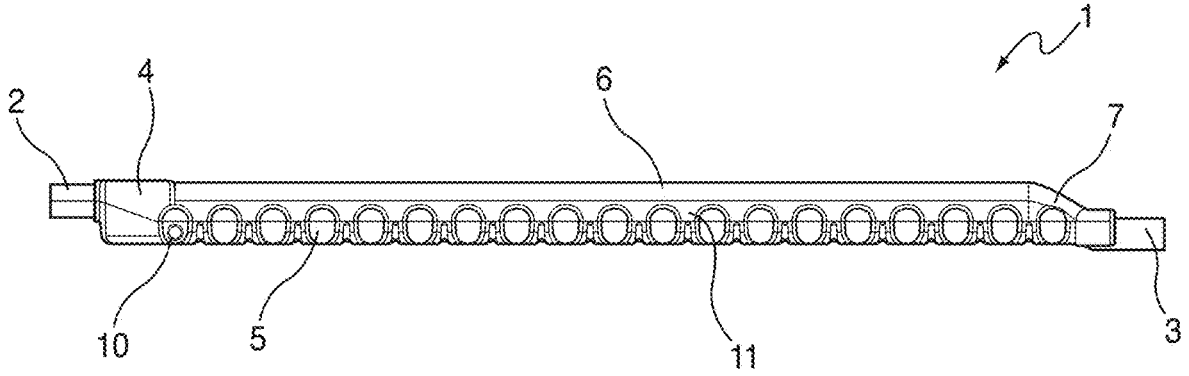
FIG. 3 is a side view of an example heat exchange apparatus.

As shown in FIG. 3, there is a downwards gradient from the waste water inlet 2 to the waste water outlet 3.

Figure 9:
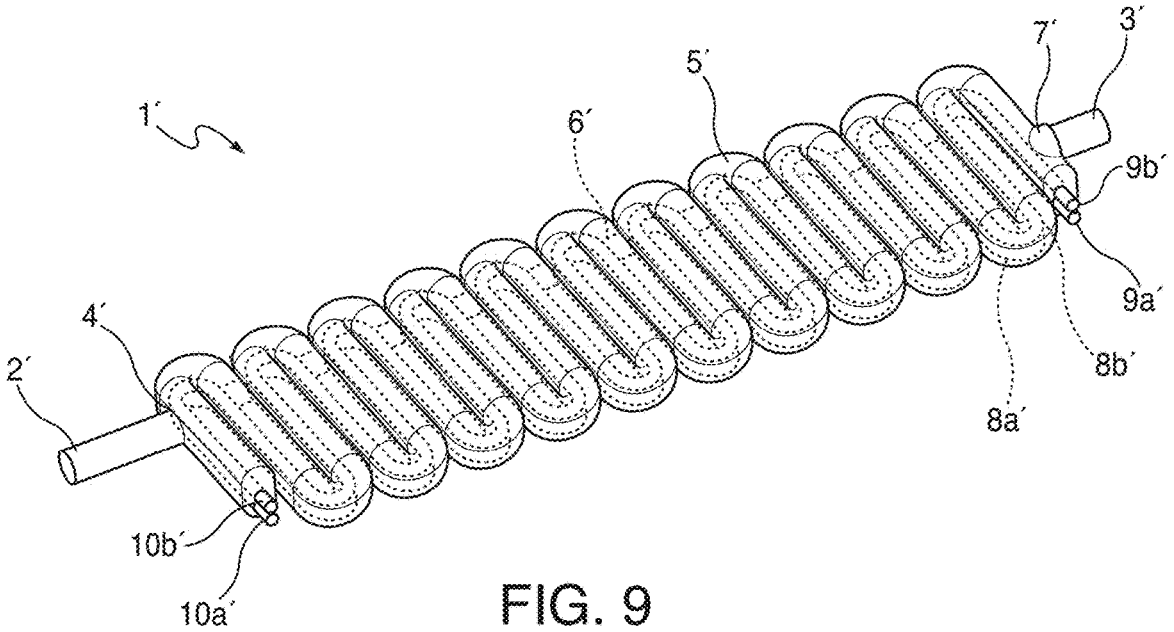
FIG. 9 is a partially transparent perspective view of another example of a heat exchange apparatus.

FIG. 9 is a partially transparent perspective view of another example of a heat exchange apparatus 1' for recovering heat from a waste water stream in a plumbing or ablutionary system.

At a first end, the heat exchange apparatus 1' comprises a waste water inlet 2' for receiving, in use, a waste water stream from a waste.

The waste water inlet 2' leads to an input manifold 4' having an input manifold inlet, a first input manifold outlet and a second input manifold outlet. The input manifold inlet is configured to receive a flow of waste water from the waste water inlet 2'. The first input manifold outlet leads to a first end of a waste water conduit 5'. The second input manifold outlet leads to a first end of an overflow pipe 6' for excess waste water.

At a second end, the heat exchange apparatus 1' comprises a waste water outlet 3'. An output manifold 7' is disposed upstream of the waste water outlet 3'. The output manifold 7' includes a first output manifold inlet, a second output manifold inlet and an output manifold outlet. The first output manifold inlet is connected to a second end of the waste water conduit 5'. The second output manifold inlet is connected to a second end of the overflow pipe 6'. The output manifold outlet leads to the waste water outlet 3'.

A first water supply pipe **8*a*' has a first end 9*a*' and a second end 10*a*'. The first water supply pipe 8*a*' extends through the waste water conduit 5'. In use, a waste water stream flowing along the waste water conduit 5 from the first end of the waste water conduit to the second end of the waste water conduit flows in the opposite direction to a water supply stream flowing along the first water supply pipe 8*a*' from the first end 9' of the water supply pipe 8*a*' to the second end 10' of the water supply pipe 8*a*'**.

A second water supply pipe **8*b*' is disposed immediately beneath the first water supply pipe 8*a*'. The second water supply pipe 8*b*' and the first water supply pipe 8*a*' are substantially identical to each other. The second water supply pipe 8*b*' has a first end 9*b*' and a second end 10*b*'. The second water supply pipe 8*b*' extends through the waste water conduit 5'. In use, a waste water stream flowing along the waste water conduit 5' from the first end of the waste water conduit to the second end of the waste water conduit flows in the opposite direction to a water supply stream flowing along the second water supply pipe 8*b*' from the first end 9*b*' of the water supply pipe 8*b*' to the second end 10*b*' of the water supply pipe 8*b*'. The first water supply pipe 8*a*' and the second water supply pipe 8*b*' are each configured to receive a water supply stream from a common source, typically a mains water supply. The water supply stream from the common source may be split between the first water supply pipe 8*a*' and the second water supply pipe 8*b*'. The water supply streams may then be recombined after they have passed out of the second ends 10*a*', 10*b*' of the first and second water supply pipes 8*a*', 8*b*'** respectively. Splitting the water supply stream from a common source between a plurality of water supply pipes that extend through the waste water conduit may provide for better heat exchange from the waste water stream flowing along the waste water conduit to the water supply streams flowing along the water supply pipes by providing an increased surface area for heat exchange. Additionally or alternatively, splitting the water supply stream from a common source between a plurality of water supply pipes that extend through the waste water conduit may lead to a reduced pressure loss in the water supply stream as it passes through the heat exchange apparatus. In implementations, the heat exchange apparatus may comprise any number and arrangement of water supply pipes extending through the waste water conduit.

The waste water conduit 5' is serpentine in form and comprises a plurality of straight sections connected by hairpin bends. In the illustrated example, the waste water conduit 5' comprises 22 straight sections and 21 hairpin bends. The straight sections of the waste water conduit 5' are oriented substantially perpendicularly to the overflow pipe 6' which extends directly in a straight line from the input manifold 4' to the output manifold 7'. The waste water conduit 5' is disposed beneath the overflow pipe 6'. The overflow pipe 6' is housed within and passes along an upper portion of a spine. The waste water conduit 5' in its serpentine form passes repeatedly through a lower portion of the spine in a direction substantially perpendicular to the overflow pipe 6'. The spine helps to keep the heat exchange apparatus 1' relatively rigid.

The first water supply pipe 8*a*' and/or the second water supply pipe 8*b*' may comprise a metal tube, e.g. a copper tube. For instance, the first water supply pipe 8*a*' and the second water supply pipe 8*b*' may comprise a twin-walled copper tube. An inner surface of the first water supply pipe 8*a*' and/or the second water supply pipe 8*b*' may comprise one or more features to promote heat transfer, e.g. heat transfer fins or the like. For example, the one or more features to promote heat transfer may comprise one or more ridges in or on the inner surface of the first water supply pipe 8*a*' and/or the second water supply pipe 8*b*'. The one or more features to promote heat transfer, e.g. one or more ridges, may extend a distance along a length of the first water supply pipe 8*a*' and/or the second water supply pipe 8*b*'. In an implementation, at least a portion of the inner surface of the first water supply pipe 8*a*' and/or the second water supply pipe 8*b*' may be rifled. The one or more features to promote heat transfer, e.g. one or more ridges, in or on the inner surface of the first water supply pipe 8*a*' and/or the second water supply pipe 8*b*' may serve to reduce, disrupt or prevent local recirculations or "dead zones", which may provide for a more efficient utilisation of the first water supply pipe 8*a*' and/or the second water supply pipe 8*b*'.

The first water supply pipe 8*a*' and/or the second water supply pipe 8*b*' may be spaced from the inner surfaces of the waste water conduit 5'. Accordingly, in use, the first water supply pipe 8*a*' and/or the second water supply pipe 8*b*' may be surrounded by the waste water stream flowing along the waste water conduit 5'.

In use, the water supply streams flowing in first water supply pipe 8*a*' and/or the second water supply pipe 8*b*' is/are in an antiparallel counterflow heat exchanging relationship with the waste water stream flowing along a length of the serpentine portion of the waste water conduit 5'.

The input manifold 4' is disposed above the waste water conduit 5'. Accordingly, the waste water stream flows downwards through the first input manifold outlet into the waste water conduit 5'. If, at any time, there is excess water in the waste water stream and the waste water conduit 5' does not have capacity to receive all of the waste water stream, the excess water in the waste water stream may flow straight on through the second input manifold outlet into the overflow pipe 6'.

Figure 10:
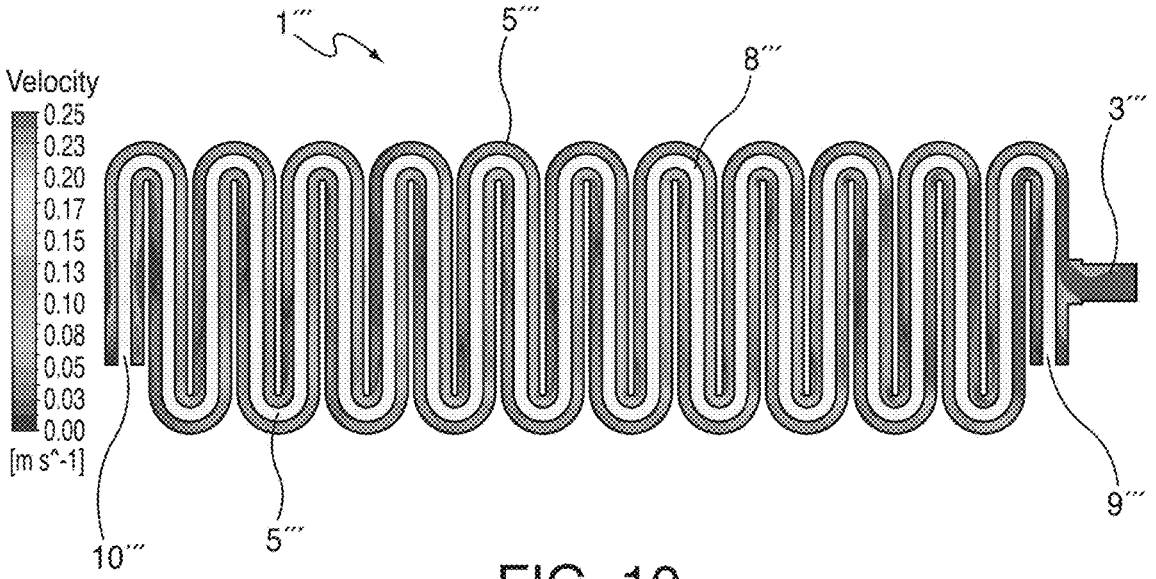
FIG. 10 shows the results of a computational fluid dynamics simulation of the fluid flow velocity along a waste water conduit of an example heat exchange apparatus.

FIG. 10 shows the results of a computational fluid dynamics simulation of the fluid flow velocity along a waste water conduit 5''' of another example of a heat exchange apparatus 1''' for recovering heat from a waste water stream in a plumbing or ablutionary system. The heat exchange apparatus 1''' is similar to the heat exchange apparatus 1' described above, except that there is only one water supply pipe 8'''.

At a first end, the heat exchange apparatus 1''' comprises a waste water inlet 2''' for receiving, in use, a waste water stream from a waste.

The waste water inlet 2''' leads to an input manifold having an input manifold inlet, a first input manifold outlet and a second input manifold outlet. The input manifold inlet is configured to receive a flow of waste water from the waste water inlet 2'''. The first input manifold outlet leads to a first end of the waste water conduit 5'''. The second input manifold outlet leads to a first end of an overflow for excess waste water.

At a second end, the heat exchange apparatus 1''' comprises a waste water outlet 3'''. An output manifold is disposed upstream of the waste water outlet 3'''. The output manifold includes a first output manifold inlet, a second output manifold inlet and an output manifold outlet. The first output manifold inlet is connected to a second end of the waste water conduit 5'''. The second output manifold inlet is connected to a second end of the overflow pipe. The output manifold outlet leads to the waste water outlet 3'''.

A water supply pipe 8''' has a first end 9''' and a second end 10'''. The water supply pipe 8''' extends through the waste water conduit 5'''. In use, the waste water stream flowing along the waste water conduit 5''' from the first end of the waste water conduit 5''' to the second end of the waste water conduit 5''' flows in the opposite direction to a water supply stream flowing along the water supply pipe 8''' from the first end 9''' of the water supply pipe 8''' to the second end 10''' of the water supply pipe 8'''.

The waste water conduit 5''' is serpentine in form and comprises a plurality of straight sections connected by hairpin bends. In the illustrated example, the waste water conduit 5'''comprises 22 straight sections and 21 hairpin bends. The straight sections of the waste water conduit 5''' are oriented substantially perpendicularly to the overflow pipe which extends directly in a straight line from the input manifold to the output manifold. The waste water conduit 5''' is disposed beneath the overflow pipe. The overflow path is housed within and passes along an upper portion of a spine. The waste water conduit 5''' in its serpentine form passes repeatedly through a lower portion of the spine in a direction substantially perpendicular to the overflow pipe 6'''. The spine helps to keep the heat exchange apparatus 1''' relatively rigid.

The shading shows the fluid flow velocity within the waste water conduit 5'''. The computational fluid dynamics simulation assumed that the waste water stream has a fluid flow rate of 9.2 litres/minute and that the water supply stream has a fluid flow rate of 9.2 litres/minute. Locally, the fluid flow velocity varies within the waste water conduit 5''', as shown by the shading.

Figure 11:
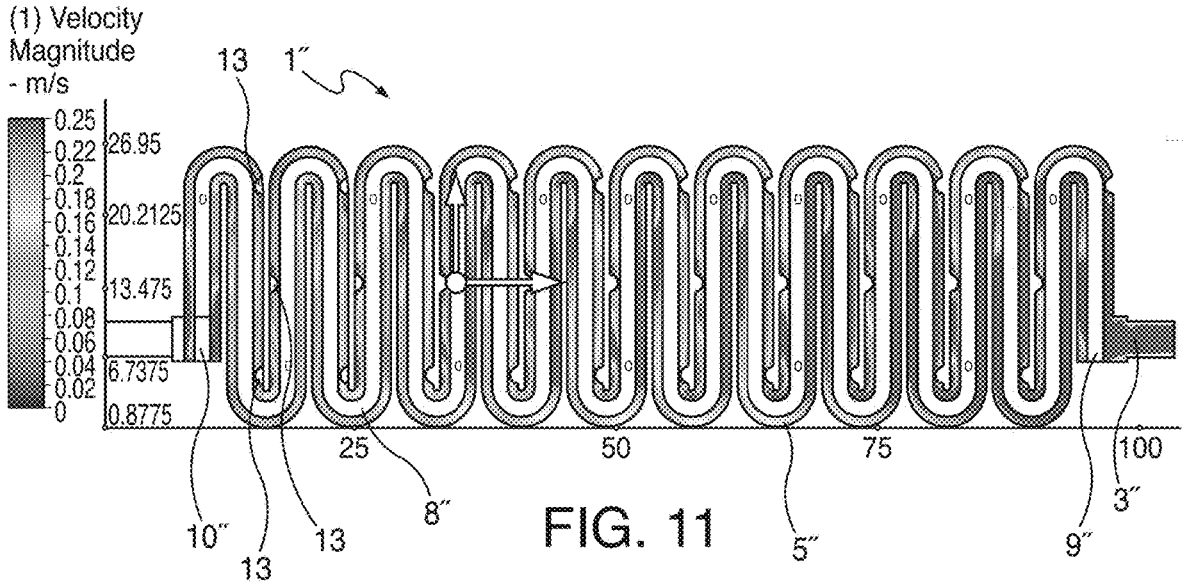
FIG. 11 shows the results of a computational fluid dynamics simulation of the fluid flow velocity along a waste water conduit of another example heat exchange apparatus.

FIG. 11 shows the results of a computational fluid dynamics simulation of the fluid flow velocity along a waste water conduit 5'' of another example of a heat exchange apparatus 1'' for recovering heat from a waste water stream in a plumbing or ablutionary system. The heat exchange apparatus 1'' is similar to the heat exchange apparatus 1''' described above.

At a first end, the heat exchange apparatus 1'' comprises a waste water inlet 2'' for receiving, in use, a waste water stream from a waste.

The waste water inlet 2'' leads to an input manifold having an input manifold inlet, a first input manifold outlet and a second input manifold outlet. The input manifold inlet is configured to receive a flow of waste water from the waste water inlet 2''. The first input manifold outlet leads to a first end of the waste water conduit 5''. The second input manifold outlet leads to a first end of an overflow for excess waste water.

At a second end, the heat exchange apparatus 1'' comprises a waste water outlet 3''. An output manifold is disposed upstream of the waste water outlet 3''. The output manifold includes a first output manifold inlet, a second output manifold inlet and an output manifold outlet. The first output manifold inlet is connected to a second end of the waste water conduit 5''. The second output manifold inlet is connected to a second end of the overflow pipe. The output manifold outlet leads to the waste water outlet 3''.

A water supply pipe 8" has a first end 9" and a second end 10". The water supply pipe 8" extends through the waste water conduit 5". In use, the waste water stream flowing along the waste water conduit 5" from the first end of the waste water conduit 5" to the second end of the waste water conduit 5" flows in the opposite direction to a water supply stream flowing along the water supply pipe 8" from the first end 9" of the water supply pipe 8" to the second end 10" of the water supply pipe 8".

The waste water conduit 5" is serpentine in form and comprises a plurality of straight sections connected by hairpin bends. In the illustrated example, the waste water conduit 5" comprises 22 straight sections and 21 hairpin bends. The straight sections of the waste water conduit 5" are oriented substantially perpendicularly to the overflow pipe which extends directly in a straight line from the input manifold to the output manifold. The waste water conduit 5" is disposed beneath the overflow pipe. The overflow pipe may be housed within and may pass along an upper portion of a spine. The waste water conduit 5" in its serpentine form may pass repeatedly through a lower portion of the spine, if present, in a direction substantially perpendicular to the overflow pipe. The spine, if present, may help to keep the heat exchange apparatus 1" relatively rigid.

The shading shows the fluid flow velocity within the waste water conduit 5". The computational fluid dynamics simulation assumed that the waste water stream has a fluid flow rate of 9.2 litres/minute and that the water supply stream has a fluid flow rate of 9.2 litres/minute. Locally, the fluid flow velocity varies within the waste water conduit 5", as shown by the shading. At 31 points where the fluid flow velocity was relatively slow in FIG. 10, there are protrusions 13 extending distance from a side wall of the waste water conduit 5" in a direction towards the water supply pipe 8". The protrusions 13 are regularly spaced along the length of the waste water conduit 5". Only the first three of the protrusions 13 are labelled for clarity. Each protrusion 13 locally decreases the width of the waste water conduit 5", thereby locally increasing the fluid flow velocity. Conditioning the fluid flow in the waste water conduit 5" to increase locally the fluid flow velocity may have a beneficial effect on the heat transfer efficiency of the heat exchange apparatus 1".

Figure 12:
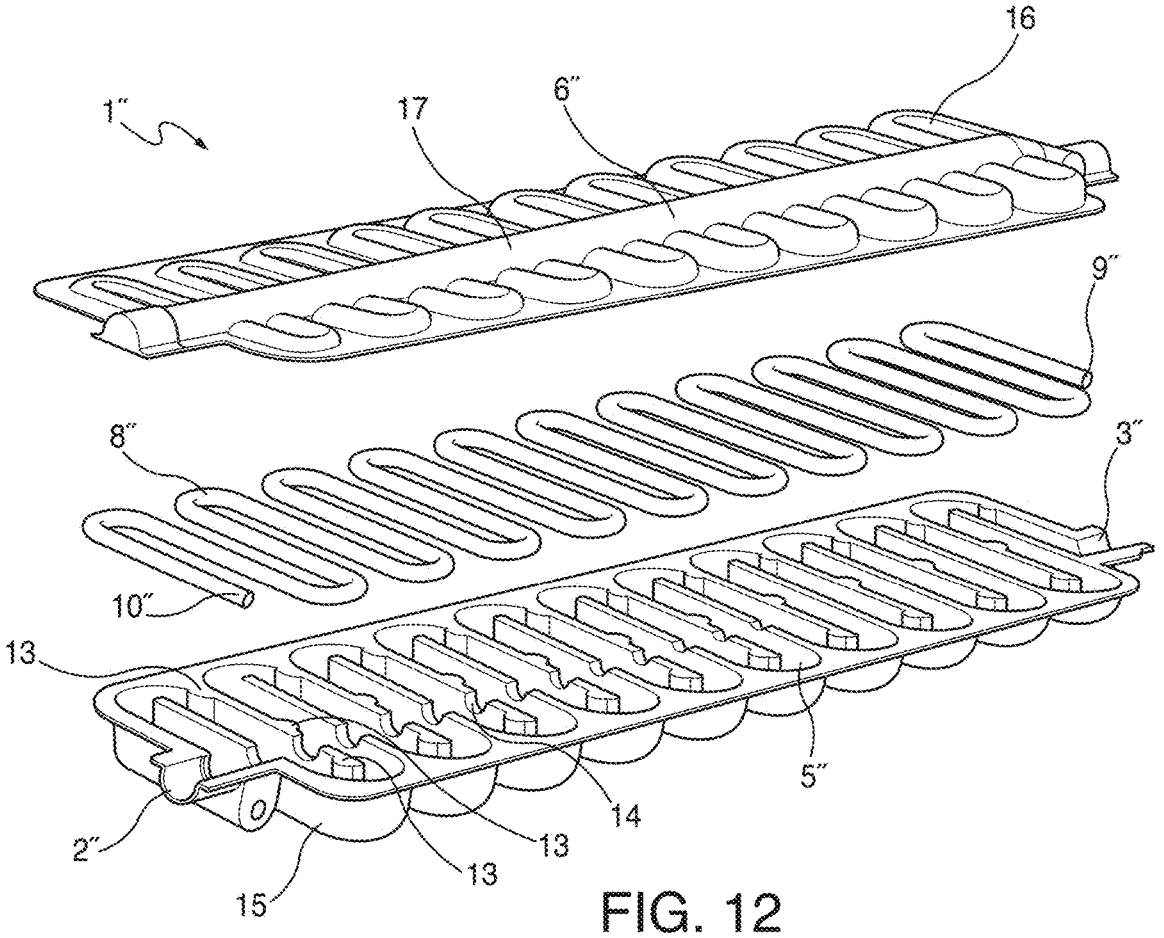
FIG. 12 is an exploded view of another example of a heat exchange apparatus.

FIG. 12 shows an exploded view of the heat exchange apparatus 1".

The heat exchange apparatus 1" comprises a first part 15 and a second part 16.

The first part 15 is made of a polymeric material and may be manufactured by vacuum forming. The first part 15 constitutes a lower part of the heat exchange apparatus 1".

The second part 16 is made of a polymeric material and may be manufactured by vacuum forming. The second part 16 constitutes an upper part of the heat exchange apparatus 1".

The first part 15 and the second part 16 may be joined together by any suitable means to form an outer shell of the heat exchange apparatus 1". The outer shell of the heat exchange apparatus 1" includes the waste water inlet 2" and the waste water outlet 3". The waste water conduit 5" extends between the waste water inlet 2" and the waste water outlet 3".

The water supply pipe 8" is accommodated within the outer shell of the heat exchange apparatus 1". The first end 9" of the water supply pipe 8" is disposed outboard of the first part 15 of the outer shell of the heat exchange apparatus 1". The second end 10" of the water supply pipe 8" is disposed outboard of the first part 15 of the outer shell of the heat exchange apparatus 1".

The water supply pipe 8" may comprise a metal tube, e.g. a copper tube. For instance, the water supply pipe 8" may comprise a twin-walled copper tube. An inner surface of the water supply pipe 8" may comprise one or more features to promote heat transfer, e.g. heat transfer fins or the like. For example, the one or more features to promote heat transfer may comprise one or more ridges in or on the inner surface of the water supply pipe 8". The one or more features to promote heat transfer, e.g. one or more ridges, may extend a distance along a length of the water supply pipe 8". In an implementation, at least a portion of the inner surface of the water supply pipe 8" may be rifled. The one or more features to promote heat transfer, e.g. one or more ridges, in or on the inner surface of the water supply pipe 8" may serve to reduce, disrupt or prevent local recirculations or "dead zones", which may provide for a more efficient utilisation of the water supply pipe 8".

The waste water conduit 5" is defined mostly by the first part 15. The protrusions 13 are each formed in a side wall of the waste water conduit 5". The same three protrusions 13 are labelled in FIG. 12 as in FIG. 11.

The heat exchange apparatus 1" includes an overflow 6" for excess waste water. The first part 15 includes a plurality of aligned semi-circular cut-outs 14 in the side walls of the waste water conduit 5". Only one of the cut-outs 14 is labelled for clarity.

In an implementation, the overflow 6" may comprise a pipe (not shown) that extends from the vicinity of the waste water inlet 2" to the vicinity of the waste water outlet 3". The pipe may be received in the cut-outs 14 and a channel 17 extending lengthways across the second part 16. The channel 17 is disposed directly above the cut-outs 14.

In another implementation, the overflow 6" may not comprise a pipe. The overflow 6" may be formed by the channel 17 and the cut-outs 14. If there is excess water in the waste water conduit 5" at any point, then the excess water can flow over the top of the waste water conduit 5" along the overflow 6".

Figure 13:
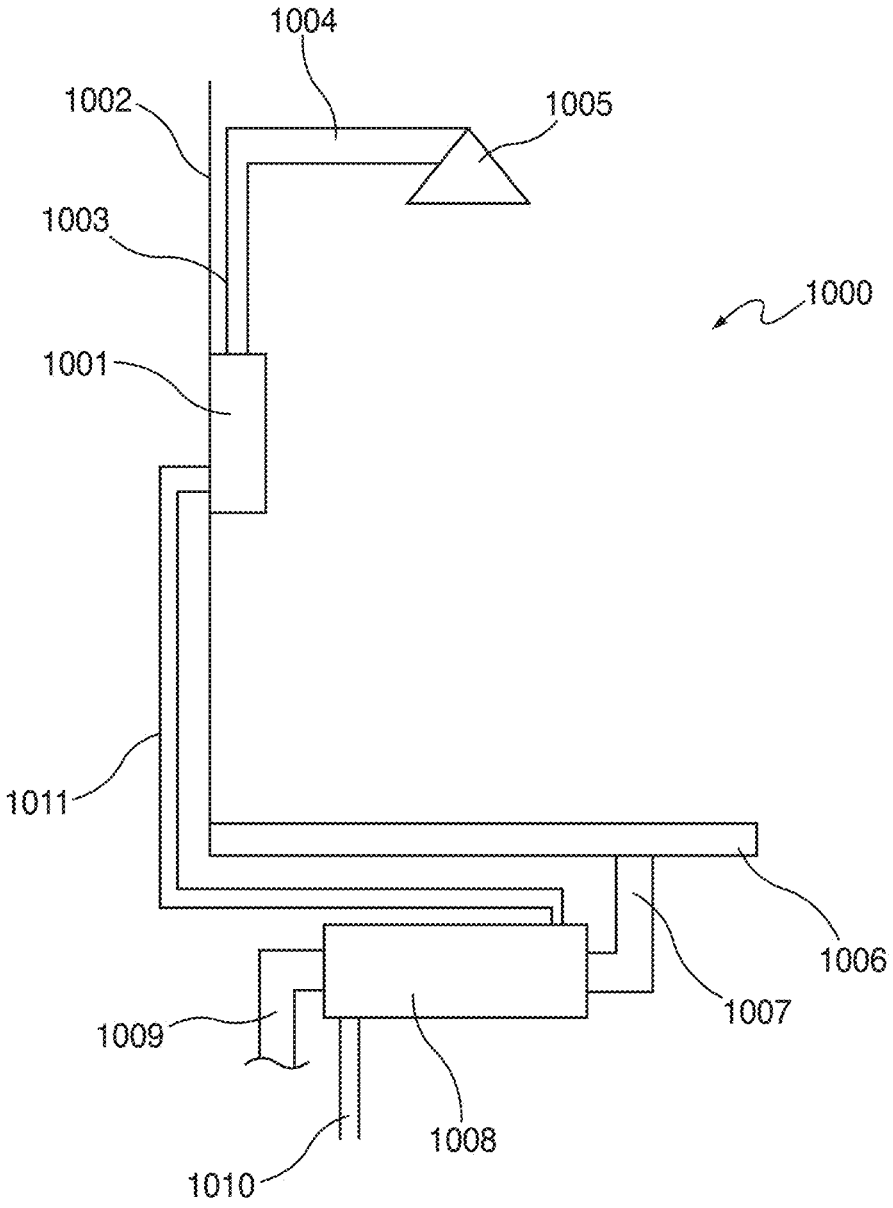
FIG. 13 shows schematically a shower system including a heat exchange apparatus.

FIG. 13 show schematically a shower system 1000.

The shower system 1000 includes an instantaneous water heater 1001 mounted on a wall 1002. The instantaneous water heater 1001 may comprise one or more electric heating elements operable to heat water flowing through the instantaneous water heater 1001 to a user-desired temperature.

A riser bar 1003 and an arm 1004 extending away from the wall 1002 connect the instantaneous water heater 1001 to a shower head 1005. The riser bar 1003 and the arm 1004 convey, in use, a stream of water having the user-desired temperature to the shower head 1005.

A shower tray 1006 is located a distance beneath the shower head 1005. The shower tray 1006 is arranged to collect water emitted from the shower head 1005.

A waste 1007 is connected to the shower tray 1006. The waste 1007 is configured to receive a waste water stream from the shower tray 1006.

The shower system 1000 includes a heat exchange apparatus 1008 according to the present disclosure. The heat exchange apparatus 1008 may be one of the example heat exchange apparatuses described herein, e.g. the heat exchange apparatus 1, the heat exchange apparatus 1', the heat exchange apparatus 1" or the heat exchange apparatus 1".

A waste water inlet of the heat exchange apparatus 1008 is connected to the waste 1007. The waste water inlet receives, in use, the waste water stream from the waste. The heat exchange apparatus 1008 comprises a waste water outlet. The waste water outlet is connected to a drain pipe 1009 for conveying the waste water stream to a drain (not shown).

The heat exchange apparatus 1008 comprises a waste water stream flow path from the waste water inlet to the waste water outlet, the waste water stream flow path being provided at least in part by a waste water conduit having a serpentine portion along at least a portion of a length of the waste water conduit.

The shower system 1000 includes a first water supply conduit 1010 configured to convey a water supply stream from a mains water supply to a water supply inlet of the heat exchange apparatus 1008. The heat exchange apparatus 1008 comprises a water supply outlet. A second water supply conduit 1011 connects the water supply outlet to an inlet of the instantaneous water heater 1001. The second water supply conduit 1011 is configured to convey, in use, the water supply stream from the heat exchange apparatus 1008 to the instantaneous water heater 1001.

The heat exchange apparatus 1008 comprises a water supply stream flow path from the water supply inlet to the water supply outlet, the water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit.

When the waste water stream has a higher temperature than the water supply stream heat is exchanged from the waste water stream to the water supply stream, thereby increasing the temperature of the water supply stream prior to its being received by the instantaneous water heater 1001.

The heat exchange apparatus 1008 may be located beneath the shower tray 1006, e.g. within a plinth or within a cavity underneath a floor such as between joists.

Initial prototype testing was carried out on a first shower system having the general form of the shower system 1000 shown in FIG. 13, in which the heat exchange apparatus 1008 was the heat exchange apparatus 1", but without the protrusions 13 formed in a side wall of the waste water conduit 5". The water supply pipe 8" comprised a twin-walled copper tube having an outer diameter of 16.5 mm. The overflow 6" did not comprise a pipe. The instantaneous water heater 1001 was operated to provide a flow of water having a typical showering temperature of 40° C. The shower system 1000 was run for a period of eight minutes with the shower head 1005 emitting 9.2 litres/minute of water having a temperature of approximately 40° C. The water supply stream from the mains water supply had a temperature of approximately 10° C. Under these test conditions, the heat exchange apparatus was found to have a 42.5% efficiency in recovering heat from the waste water stream.

Initial prototype testing was also carried out on a second shower system having the general form of the shower system 1000 shown in FIG. 13, in which the heat exchange apparatus 1008 was the heat exchange apparatus 1". The water supply pipe 8" comprised a twin-walled copper tube having an outer diameter of 13.5 mm. The overflow 6" did not comprise a pipe. The instantaneous water heater 1001 was operated to provide a flow of water having a typical showering temperature of 40° C. The shower system 1000 was run for a period of eight minutes with the shower head 1005 emitting 9.2 litres/minute of water having a temperature of approximately 40° C. The water supply stream from the mains water supply had a temperature of approximately 10° C. Under these test conditions, the heat exchange apparatus 1" was found to have a 40% efficiency in recovering heat from the waste water stream.

It will be appreciated that the shower system 1000 merely constitutes an example of a plumbing or ablutionary system according to the present disclosure.

In other implementations, the plumbing or ablutionary system may comprise a bathtub instead of a shower tray. The bathtub may be arranged to collect water emitted from one or more fluid delivery devices, e.g. one or faucets or taps and/or one or more shower heads. In such an implementation, the heat exchange apparatus may be located beneath the bathtub. A heat exchange apparatus intended to be located beneath a bathtub may have a larger footprint than a heat exchange apparatus intended to be located beneath a shower tray.

Generally, the heat exchange apparatus may have a relatively flat and/or compact form factor. Accordingly, the heat exchange apparatus may be accommodated within, for example, a bathtub or a shower tray or a plinth beneath a bathtub or a shower tray or within a cavity underneath a floor such as between joists.

The serpentine portion of the waste water conduit and/or of the water supply pipe may have any generally serpentine form. The serpentine portion of the waste water conduit and/or of the water supply pipe may or may not lie in a common plane. The serpentine portion of the waste water conduit and/or of the water supply pipe may have any number and/or suitable arrangement of bends and, optionally, sections between the bends.

The embodiments discussed in this disclosure are intended as specific examples and are not meant as limiting. Any and all features discussed in this disclosure may be used in combination with any other features discussed in this disclosure, within the scope as defined in the claims.

The invention claimed is:

1. A plumbing or ablutionary system comprising:

a principal water stream device receiving a water supply stream and providing a principal stream having a controlled temperature;

a fluid delivery device connected with and in fluid communication with the principal water stream device to receive the principal stream and emit water therefrom;

a receptacle having a collection surface arranged to collect water emitted from a fluid delivery device and having a waste connected thereto; and a heat exchange apparatus comprising:

a waste water inlet receiving a waste water stream from the waste;

a waste water outlet;

a first waste water stream flow path from the waste water inlet to the waste water outlet, the first waste water stream flow path being provided at least in part by a waste water conduit having a serpentine portion along at least a portion of a length of the waste water conduit, wherein the waste water conduit includes an inner wall;

a water supply inlet for receiving the water supply stream;

a water supply outlet;

a water supply stream flow path from the water supply inlet to the water supply outlet, the water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit, wherein the water supply pipe is defined by an outer wall;

wherein when the waste water stream has a higher temperature than the water supply stream heat is exchanged from the waste water stream to the water supply stream, thereby increasing the temperature of the water supply stream prior to its being received by the principal water stream device; and wherein the inner wall of the waste water conduit is the outer wall of the water supply pipe.

2. The system of claim 1, wherein the principal water stream device includes an instantaneous water heater or a mixer valve.

3. The system of claim 1, wherein the fluid delivery device includes a faucet or a sprayer for a shower.

4. The system of claim 1, wherein the receptacle includes a shower tray, a bathtub, or a basin.

5. A heat exchange apparatus comprising:

a waste water inlet;

a waste water outlet;

a first waste water stream flow path from the waste water inlet to the waste water outlet, the first waste water stream flow path being provided at least in part by a waste water conduit having a serpentine portion along at least a portion of a length of the waste water conduit, wherein the waste water conduit includes an inner wall;

a water supply inlet for receiving a water supply stream;

a water supply outlet;

a water supply stream flow path from the water supply inlet to the water supply outlet, the water supply stream flow path being provided at least in part by a water supply pipe configured such that, in use, the water supply stream flowing in the water supply pipe is in an antiparallel counterflow heat exchanging relationship with a waste water stream flowing along a length of the serpentine portion of the waste water conduit, wherein the water supply pipe is defined by an outer wall;

wherein when the waste water stream has a higher temperature than the water supply stream heat is exchanged from the waste water stream to the water supply stream, thereby increasing the temperature of the water supply stream; and wherein the inner wall of the waste water conduit is the outer wall of the water supply pipe.

6. The heat exchange apparatus of claim 5, wherein the waste water conduit includes a channel, a trough and/or a pipe.

7. The heat exchange apparatus of claim 5, wherein the waste water conduit includes one or more formations that reduce locally a width of the waste water conduit to increase locally flow rate of the waste water stream along the waste water conduit.

8. The heat exchange apparatus of claim 5, wherein the heat exchange apparatus includes an overflow for excess waste water.

9. The heat exchange apparatus of claim 5, wherein the heat exchange apparatus includes a plurality of water supply stream flow paths, each water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit.

10. The heat exchange apparatus of claim 5, wherein one or more of the water supply pipes comprise a metal tube.

11. The system of claim 1, wherein the waste water conduit includes a channel, a trough and/or a pipe.

12. The system of claim 1, wherein the waste water conduit includes one or more formations that reduce locally a width of the waste water conduit to increase locally flow rate of the waste water stream along the waste water conduit.

13. The system of claim 1, wherein the heat exchange apparatus includes an overflow for excess waste water.

14. The system of claim 1, wherein the heat exchange apparatus includes a plurality of water supply stream flow paths, each water supply stream flow path being provided at least in part by a water supply pipe configured such that, in use, the water supply stream flowing in the water supply pipe is in an antiparallel counterflow heat exchanging relationship with the waste water stream flowing along a length of the serpentine portion of the waste water conduit.

15. The system of claim 1, wherein one or more of the water supply pipes comprise a metal tube.

* * * * *